United States Patent [19]

Hoffman

[11] Patent Number: 4,761,853

[45] Date of Patent: Aug. 9, 1988

[54] SELF-CLOSING HINGE STRUCTURE

[75] Inventor: George H. Hoffman, St. Louis, Mo.

[73] Assignee: Allied Plastics Enterprises, Inc., St. Louis, Mo.

[21] Appl. No.: 38,518

[22] Filed: Apr. 15, 1987

[51] Int. Cl.[4] ..... E05F 1/12

[52] U.S. Cl. ..... 16/302; 16/74; 16/354

[58] Field of Search ..... 16/354, 282, 302, 277, 16/356, 366, 74

[56] References Cited

U.S. PATENT DOCUMENTS

| | | | |
|---|---|---|---|
| 3,092,870 | 6/1963 | Baer | 16/354 |
| 3,382,205 | 5/1968 | Beels . | |
| 3,402,422 | 9/1968 | Baer | 16/354 |
| 3,864,786 | 2/1975 | Salice | 16/302 |

FOREIGN PATENT DOCUMENTS

| | | | |
|---|---|---|---|
| 2457413 | 6/1975 | Fed. Rep. of Germany | 16/354 |

*Primary Examiner*—Fred A. Silverberg

*Attorney, Agent, or Firm*—Lockwood, Alex, FitzGibbon & Cummings

[57] ABSTRACT

A geared hinge is formed by a pair of intermeshed geared hinge members which are maintained in mesh by a connector member. When the hinge members are in one position there are longitudinal recesses which are diminished in volume when the hinge members are in an alternate position. Deposits of resilient rubber-like material are inserted into the open recesses. These deposits are compressed when the hinge members are moved toward the alternate position. The resistance to compression imparts a self-closing action to the hinge.

8 Claims, 1 Drawing Sheet

FIG. 1
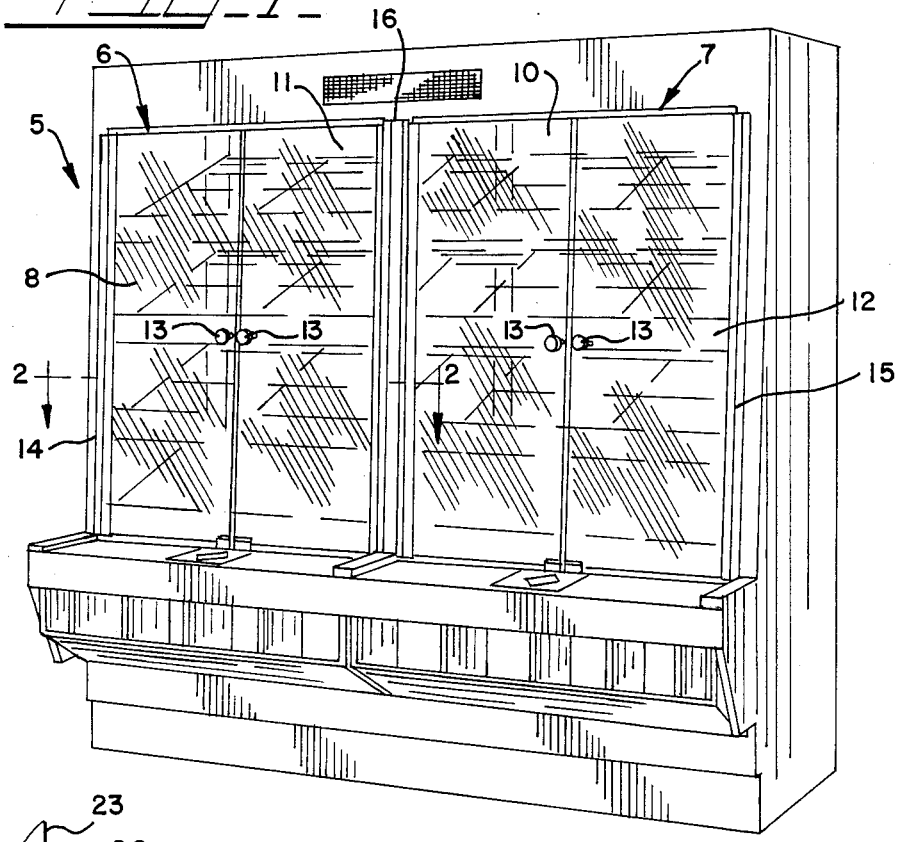
FIG. 2
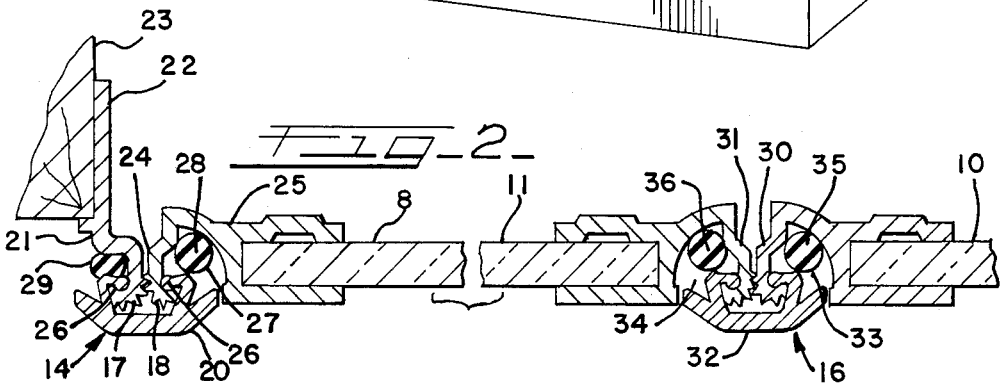
FIG. 3
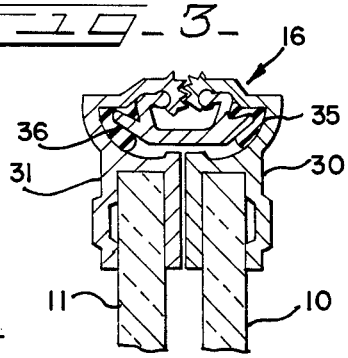
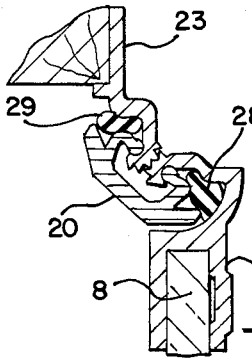
FIG. 4

SELF-CLOSING HINGE STRUCTURESPECIFICATION

This invention relates, generally, to innovations and improvements in self-closing hinge structures. It relates more particularly to self-closing hinge structures which embody intermeshed geared hinge members and a connector member maintaining the geared hinge members in mesh.

Geared hinge structures of the type to which the present invention relate are disclosed in U.S. Pat. Nos. 3,092,870 and 3,402,422 granted to Austin R. Baer. However, the hinges disclosed in these two patents do not incorporate any self-closing features.

Briefly stated, it has been discovered in accordance with this invention that the geared hinges of the type disclosed in the Baer patents can be manufactured as or converted into self-closing hinges by introduction of elongated cushions of resilient rubber-like materials such as silicone rubber.

The object of the invention, generally stated, is the provision of self-closing hinges which rely upon forces developed in resilient rubber-like materials under compression.

A more specific object of the invention is the provision of self-closing hinges of the type having intermeshed geared hinge members in which elongated cushions or deposits of resilient rubber-like material are introduced without having to alter the conventional designs of such hinges.

Certain other objects of the invention will be apparent to those skilled in the art from the following detailed description of presently preferred embodiments of the invention taken in connection with the accompanying drawings wherein:

FIG. 1 is a perspective view of a display cabinet embodying the present invention;

FIG. 2 is a sectional view on enlarged scale taken on line 2—2 of FIG. 1; and FIG. 3 is a fragmentary view based on FIG. 2 but showing on further enlarged scale the two doors in their opened position; and FIG. 4 is a fragmentary view similar to FIG. 3 showing the left-hand door in its open position.

In FIG. 1 a cabinet is indicated generally at 5 of the type in which various goods can be displayed such as in a supermarket. The upper portion of the cabinet 5 is divided into two compartments 6 and 7. Each of the compartments is provided with a left hand door 8 and 10, respectively, and a right hand door 11 and 12, respectively. The doors 8, 10, 11 and 12 meet at the centers of the compartments 6 and 7 and swing outwardly. Each of the doors 8, 10, 11 and 12 is provided with a pull or knob 13 which may be used to swing open the respective doors. Normally, the doors will be formed of glass or clear plastic so as to be transparent and permit the contents of the cabinet 5 to be viewed.

The door 8 is hinged along its left hand vertical edge by means of a hinge 14 while door 12 is similarly hinged along its right hand edge by a corresponding hinge structure 15. It will be understood that the hinges 14 and 15 correspond to each other but one is turned so as to be right handed and the other is turned so as to left handed.

The inner doors 10 and 11 are hinged along their left and right hand edges, respectively by a double hinge structure which is indicated at 16.

The hinges 14, 15 and 16 correspond generally with the hinge structures shown and described in the above-mentioned Baer U.S. Pat. No. 3,402,422 the disclosure of which is incorporated herein by reference. Hinge 14 comprises two intermeshed geared hinge members 17 and 18 which are maintained in mesh by a connector member 20. Each of the members 17, 18 and 20 are elongated and extend for the full height or length of the hinge 14. They may be advantageously formed of extruded aluminum, stainless steel or plastic of suitable strength and dimensional stability. The member 17 has integrally extending therefrom a flange 21 which has integrally connected therewith a mounting strip 22 permitting mounting on the interior of the frame member 23 of the cabinet 5. The geared hinge member 18 likewise has a laterally extending flange 24 integrally extending therefrom and which has integrally formed thereon a vertically grooved or slotted member 25 into the vertical groove of which the left hand edge or margin of the door panel 8 may be secured.

The connector member 20 carries integrally formed pintles 26—26 which seat in elongated socket grooves provided therefore in the gear sectors of the members 17 and 18.

The formation of the connector member 20, flange 24 and flange extension 25 are such as to provide surfaces which define a recess 27 into which a bead or strip 28 of resilient rubber-like material is introduced such as by use of a caulking gun before assembly of the hinge component. One suitable material for the bead 28 is commercially available as Work Site brand silicone sealant No. 33S, from C. R. Laurence Co., Los Angeles, California. This particular material may be applied from a caulking gun and meets Federal Specification TT-S-00230C and TT-S-001543. Another suitable material is available under the name Silicone Rubber Caulk and is described in U.S. Pat. No. 3,382,205. However, various other resilient rubber-like materials can be used including natural and synthetic rubbers, especially if added during original manufacture.

The hinge 14 also includes a second bead or strip 29 of resilient rubber-like material. Since the bead 29 is located in an exterior pocket or groove which is readily accessible when the hinge 14 is in the condition shown in FIG. 2, it may be readily introduced as a retrofit operation in a hinge 14 which has been manufactured without either beads 28 or 29.

The manner in which the hinge 14 operates due to the presence of the beads 28 and 29 of resilient rubber-like material will be described below in connection with the double hinge 16 and FIGS. 3 and 4.

The structure of the hinge 16 corresponds to that of hinge 14 except that both parts of the hinge 16 are the same. Thus, the hinge members 30 and 31 correspond to the hinge member 18 of hinge 14. The connector member 32 of hinge 16 corresponds to the connector member 20 of hinge 14.

The cavities 33 and 34 in the hinge 16 are provided with beads or strips 35 and 36 of resilient rubber-like material.

When the doors 10 and 11 and swung open towards each other the recesses 33 and 34 in which the beads 35 and 36 are trapped or confined, are decreased in volume and the beads are compressed to the squeezed condition shown in FIG. 3. It will be appreciated that the degree of resistance which the beads 35 and 36 offer to being compressed depends on the volumes of the resilient rubber-like material, the nature of the material, and the degree to which the beads are compressed. These are all factors that can readily be determined and suitably designed for.

Once the doors 10 and 11 are released after having been opened, the force of compression and resistance to being compressed offered by the resilient rubber-like material will be such as to cause the doors 10 and 11 to swing back on their own from the position shown in FIG. 3 to the condition shown in FIG. 2 without any external assistance.

Referring to FIG. 4, it will be seen that both beads 28 and 29 are both in the compressed or squeezed condition. In the event a bead 28 is not present, bead 29 alone can be made to provide satisfactory self-closing action.

It will be appreciated that the invention may be utilized with various types of doors which may be hung to swing on vertical hinges or on horizontal hinges.

What is claimed is:

1. In a hinge structure comprising two intermeshed geared hinge members and a connector member maintaining said geared hinge members in mesh, each geared hinge member comprising a gear segment having an outwardly extending flange portion, each gear segment having radially inward of its teeth a recess, said connector member having spaced pintles each of which fits into one of said recesses, and at least one of said flange portions and an adjacent portion of said connector member having cooperating surfaces which define therebetween a space the volume of which increases when said cooperating surfaces separate and the volume of which decreases when said cooperating surfaces close toward each other, a deposit of resilient rubber-like material trapped in said space which deposit is compressed when the volume of said space is decreased and thereby creates a force tending to restore the volume of said space and thereby separate said surfaces, said restoring force producing a separation of said cooperating surface upon removal of the force of compression on said deposit.

2. In an elongated hinge structure comprising two elongated intermeshed gear hinge members and a connector member spanning and maintaining said geared hinge members in mesh, each geared hinge member comprising an elongated gear segment and an integral flange with each gear segment having an elongated socket radially inward of its teeth, said connector having spaced elongated pintles integrally formed thereon each of which is lodged in one of said sockets, and at least one of said flanges and an adjacent portion of said connector member having opposing surfaces which define therebetween a space the volume of which enlarges when said opposing surfaces mave apart and which decreases when said opposing surfaces move toward each other, the improvement comprising:

an elongated filling of resilient rubber-like material in said space which resists compression when the volume of said spaces is decreased producing a force tending to restore the volume of said space by separating said surfaces, said restoring force producing a separation of said cooperating surfaces upon removal of the force of compression on said deposit.

3. In the elongated hinge structure called for in claim 2 wherein at least one said space is open on one side when said opposing surfaces are moved apart so as to permit the introduction of one said elongated filling into said space through said open side.

4. In the elongated hinge structure called for in claim 2 wherein at least one said space is substantially enclosed between said opposing surfaces and one said elongated filling is confined within said enclosed space.

5. In the elongated hinge structure called for in claim 2 wherein there are two said spaces with a first space being open on one side when said opposing surfaces defining said first space are moved apart so as to permit introduction of one first said elongated fitting into said first space through said open side, and wherein a second said space is substantially enclosed between its said opposing surfaces and a second said elongated filling is confined within said second space.

6. In the elongated hinge structure called for in claim 2 wherein there are two said spaces with each being substantially enclosed between a pair of said opposing surfaces and one said elongated filling is confined within each said space.

7. In a cabinet comprising at least one self-closing door hinged along one edge to a support by an elongated hinge structure comprising two elongated intermeshed geared hinge members and an elongated connector member spanning and maintaining said geared hinge members in mesh, each said geared hinge member comprising an elongated gear segment and an elongated integral flange with each said gear segment having an elongated socket disposed radially inward of its teeth, said connector member having spaced elongated pintles integrally form thereon each of which is lodged in one of said sockets and at least one of said flanges and an adjacent portion of said connector member having opposing elongated surfaces which define therebetween an elongated space the volume of which enlarges when its said opposing surfaces move apart and which decreases when said opposing surfaces move toward each other, and said one door being mounted on said one said flange and movable therewith between closed and open positions, the improvement comprising:

an elongated filling of a resilient rubber-like material in said space which resists compression when the volume of said space is decreased producing a restoring force tending to restore the volume of said space by separating said opposing surfaces, said restoring force being sufficient to produce a separation of said cooperating surfaces upon release of said door in its open position whereupon said door swings to its closed position.

8. In a cabinet having a pair of doors hinged along one edge of each to a common support member by an elongated hinge structure comprising two elongated intermeshed gear hinge members and an elongated connector member comprising said common support member and spanning and maintaining said geared hinge members in mesh, each said geared hinge member comprising an elongated gear segment and an elongated integral flange with each said gear segment having an elongated socket disposed radially inward of its teeth, said connector member having spaced elongated pintles integrally formed thereon each of which is lodged in one of said sockets, and each of said flanges and an adjacent portion of said connector member having opposing elongated surfaces which define therebetween an elongated space the volume of which enlarges when its said opposing surfaces move apart and which decreases when its said opposing surfaces move toward each other, and each of said doors being mounted on one of said elongated flanges and movable therewith between open and close positions, the improvement which comprises:

an elongated filling of resilient rubber-like material in each said elongated space which resists compression when said volume of each said space is decreased thereby producing a restoring force tending to restore the volume thereof by separating said opposing elongated surfaces forming the same, said restoring force being sufficient to produce a separation of said cooperating elongated surfaces upon the release of the one of said doors mounted on the elongated flange providing one of said cooperating elongated surfaces.

* * * * *